United States Patent [19]

Eustacchio

[11] Patent Number: 4,990,086

[45] Date of Patent: Feb. 5, 1991

[54] SYSTEM FOR UNDER-CART COOLING OF FURNACE CARTS IN TUNNEL FURNACES

[76] Inventor: Claudio Eustacchio, Angelo-Eustacchio-Gasse 4, A-8010 Graz, Austria

[21] Appl. No.: 257,670

[22] Filed: Oct. 14, 1988

[30] Foreign Application Priority Data

Nov. 2, 1987 [EP] European Pat. Off. ..... 87116103

[51] Int. Cl.[5] ..... F27B 9/00; F27D 3/12

[52] U.S. Cl. ..... 432/133; 432/137; 432/241; 432/144; 432/77

[58] Field of Search ..... 432/241, 239, 137, 77, 432/81, 133

[56] References Cited

U.S. PATENT DOCUMENTS 4,560,350 12/1985 Doby ..... 432/241
4,722,682 2/1988 Lingl, Jr. ..... 432/137
4,744,750 5/1988 Lingl, Jr. ..... 432/241
4,772,199 9/1988 Hartmann ..... 432/241
4,773,851 9/1988 Mueller ..... 432/77
4,778,384 10/1988 Lingl, Jr. ..... 432/137

*Primary Examiner*—Henry C. Yuen
*Attorney, Agent, or Firm*—Kline, Rommel & Colbert; Kline, Rommel & Colbert

[57] ABSTRACT

A system for under-cart cooling of furnace carts in tunnel furnaces comprises a plurality of closed cooling air channels which fill the under-cart channel to the largest possible extent and are only slightly spaced from the undersides of the tent and are only slightly spaced from the undersides of the furnace carts. The cooling air channels which are streamed through by cooling air provide for sufficient cooling of the furnace carts, while simultaneously an exchange of cooling air from the under-cart channel and of hot air from the burning channel can be avoided in a simple manner so that there is no need for additional sealing arrangements.

8 Claims, 2 Drawing Sheets

SYSTEM FOR UNDER-CART COOLING OF FURNACE CARTS IN TUNNEL FURNACES

FIELD OF THE INVENTION

The present invention relates to a system for under-cart cooling of furnace carts in tunnel furnaces, which system comprises an under-cart channel which is streamed through by a coolant and defined by the foundation and the side walls of the tunnel furnace and by the undersides of the furnace carts, and which is sealed, at least to the largest possible extent, against the burning channel that is defined above the furnace carts.

DESCRIPTION OF THE BACKGROUND ART

In tunnel furnaces commonly a closed cart train is moved through the tunnel furnace, the steel structures of the furnace carts being protected against the burning channel by a superstructure of refractory and insulating materials. Since large pressure differences prevail in the burning channel due to the different temperatures and draught conditions, the under-cart channel disposed below the furnace carts must be sealed-off in order to protect the steel parts.

For sealing-off the under-cart channel disposed below the furnace carts against the burning channel, there are suggestions in the prior art to guide sand grooves laterally along the furnace carts, into which grooves the continuous sheet metal plates fastened to the lateral sides of the steel structures of the furnace carts immerge as sealing aprons. At the cart ends adjoining each other there are arranged labyrinth-like seals having refractory gasket cords.

However, the said known sealings are insufficient. Since it is required that cooling air for cooling the steel structure including furnace cart wheels with bearings be moved through the under-cart channel, there are draught and pressure conditions prevailing in the under-cart channel which are different from those in the burning channel above the furnace carts.

Tunnel furnaces in modern plants have channel widths of up to 10 meters, and the sealings of the furnace carts require higher precision than can be achieved by simple means. Thereby leaks occur between the burning channel above the furnace carts and the under-cart channel. Hot gases then escape from the burning zone and travel into the cooling channel (under-cart channel), where they endanger the steel structure and in particular the furnace cart wheels and bearings. On the other hand, cooling air escapes uncontrolledly from the cooling channel below the furnace carts, traveling into the burning channel above the furnace carts and thus damaging the material to be burnt.

From the European Patent Application No. 86 115 658.6 (publication number 0 227 927) it is known to divide the under-cart channel into separate small chambers, through which cooling pipes are led from the outside in order to cool the air in said chambers. Said cooling pipes are disposed below the furnace carts, at a distance of about 0.5 m from the steel structures of the tunnel furnace carts to be cooled. Since the furnace cart structure that is to be cooled is at the highest point of the cooling chambers, it is clear that at that point also the space and the air are the hottest.

Therefore it appears not very useful to cool the air at a distance of about 0.5 m below the undersides of the furnace carts, because as a result of its lower specific weight the hot air travels upward, and the desired natural circulation cannot be achieved to a sufficient extent. It would rather be necessary to install artificial circulation means, something that becomes uneconomical in view of up to 100 furnace carts per tunnel furnace and 2 chambers per furnace cart.

SUMMARY OF THE INVENTION

It is therefore the object of the present invention to provide by means of a simple construction the cooling of the steel structures of the furnace carts as well as of the wheels and bearings thereof and to avoid at the same time that the material to be burnt is damaged by cooling air traveling without control into the burning channel, and further to exclude that any gas exchange between the burning channel and the cooling channel takes place even in case of large pressure differences.

The object of this invention is achieved substantially in that at least one closed cooling air channel extending in the longitudinal direction of the tunnel furnace is arranged in the under-cart channel, which cooling air channel can be streamed through by cooling air, fills the under-cart channel to the largest possible extent, and is only slightly spaced from the undersides of the furnace carts.

Cooling air is led through such air-tight cooling air channel to keep the casing of the cooling air channel, which consists preferably of sheet metal, approximately at ambient temperature. Due to the proximity of this cooled sheet metal casing to the steel parts of the furnace carts the heat of these steel parts is eliminated.

Due to the very small distance of preferably less than 2 mm between the closed cooling air channel and the steel structures of the furnace carts, practically no gas streams can flow inside the under-cart channel outside the area of the cooling air channel. Hereby a longitudinal flow of air between the steel structures of the furnace cart and the sheet metal casing of the cooling air channel is virtually excluded. At the same time it is excluded that hot air escapes from the burning channel and travels into the space below the furnace carts, or that cold air escapes from the under-cart channel and travels into the burning channel. Thus, it is an essential advantage of the present invention that there is no need to provide an air-tight sealing between the burning channel and the under-cart channel.

In practice, it will be expedient to provide a plurality of parallel cooling air channels, each one of which is arranged between the wheels of the furnace carts, and between the wheels of the furnace carts and the adjacent lateral side wall of the tunnel furnace. Unless the wheels of the furnace carts are arranged at the very lateral ends of the furnace carts, there are to be provided, as a rule, three cooling air channels, that is a middle cooling air channel extending between the left and the right wheels, a left cooling air channel extending between the left wheels and the left side wall of the tunnel furnace, and a right cooling air channel extending between the right wheels and the right side wall of the tunnel furnace. Thus, there are spaces between the parallel-extending cooling air channels, in which the wheels of the furnace carts may run. In order to prevent any current of air from flowing in the longitudinal direction of the tunnel furnace through said spaces, it is provided according to another preferred embodiment of the present invention to arrange at the furnace carts vertical sealing tongues extending at right angles to the conveying direction, which sealing tongues extend into the space defined between neighboring cooling air channels and which are only slightly spaced from the cooling air channels and from the rails provided for guiding the furnace carts respectively.

BRIEF DESCRIPTION OF THE DRAWINGS

The present invention will become more fully understood from the detailed description and the claims given hereinbelow and the accompanying drawings which are given by way of illustration only, and thus are not limitative of the present invention, and wherein

DETAILED DESCRIPTION OF A PREFERRED EMBODIMENT

Figure 1:
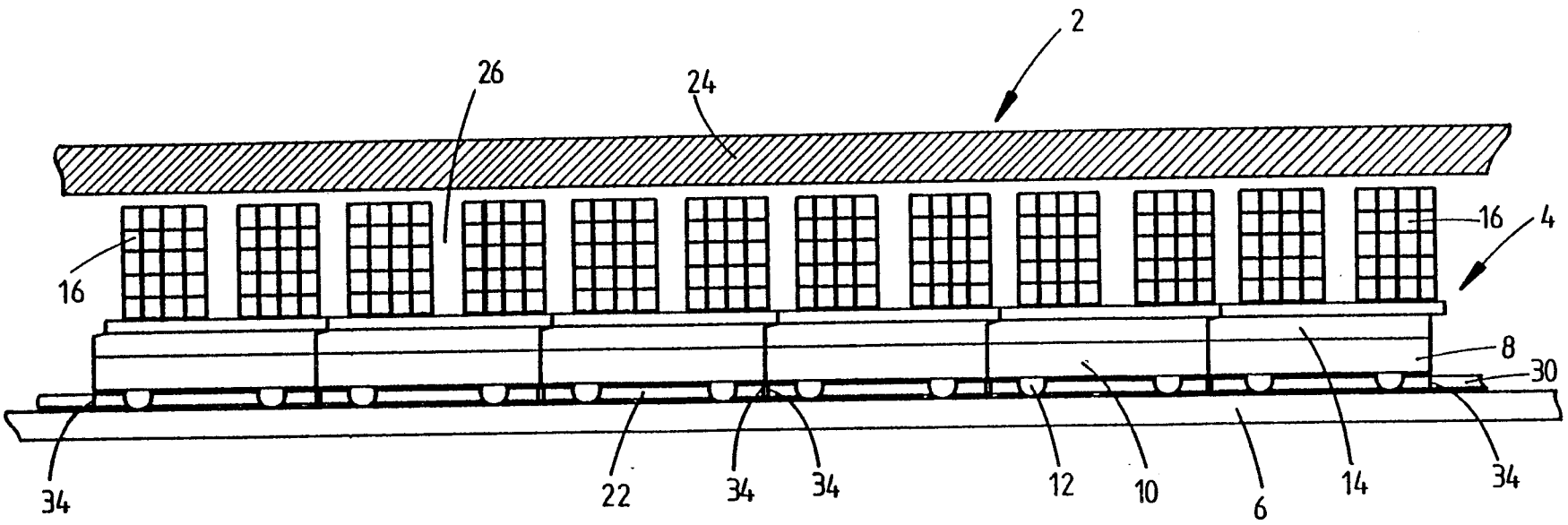
FIG. 1 is a semi-diagrammatic longitudinal section taken through a tunnel furnace equipped with a system for under-cart cooling according to the present invention.
Figure 2:
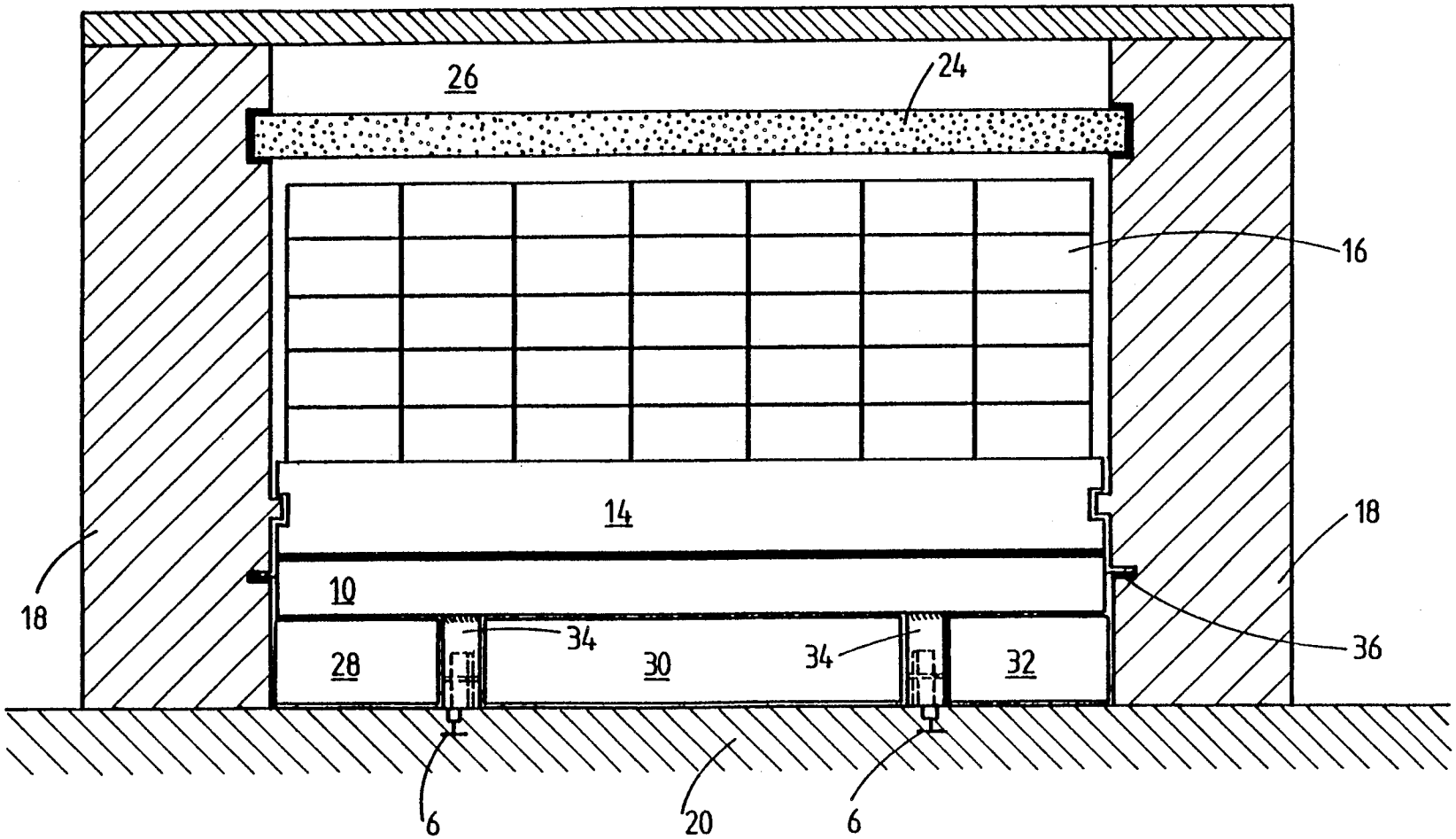
FIG. 2 is a cross-section taken through the tunnel furnace according to FIG. 1.

The furnace cart train 4, consisting of separate furnace carts 8, is moved on rails 6 through the tunnel furnace 2 as indicated in FIGS. 1 and 2. Each furnace cart 8 comprises a steel structure 10 with furnace cart wheels 12 being mounted thereto by means of bearings which are not shown in detail. The steel structure 10 has a chamotte superstructure 14, on which stacks of bricks 16 have been deposited. The under-cart channel 22 to be cooled is defined between the side walls 18 of the tunnel furnace 2, the foundation 20 of the tunnel furnace 2 and the undersides of the steel structures 10 of the furnace carts 8. The burning channel 26 is defined above the under-cart channel 22 between the chamotte superstructure 14 of the furnace cart 8, the side walls 18 and the burning channel ceiling 24 of the tunnel furnace.

Inside the under-cart channel 22 there are provided three cooling air channels 28, 30, 32 extending in the longitudinal direction of the tunnel furnace 2. Said cooling air channels are of rectangular cross-section, rest upon the foundation 20 and abut the side walls 18 of the tunnel furnace 2, and are only slightly spaced, i.e. at a distance of less than 2 mm, from the underside of the steel structure 10. The cooling air channels 28 to 32 are preferably made of sheet metal. Between the cooling air channels 28, 30, and 30, 32, there are defined spaces for the furnace cart wheels 12 to run therein. On the underside of said space there are disposed the rails 6.

For sealing-off the above-referenced space between the sheet metal cooling air channels 28, 30, and 30, 32, there are welded vertically extending sealing tongues 34 to the undersides of the steel structures 10 of the furnace carts 8, which sealing tongues are preferably provided at the front end and at the rear end of each furnace cart 8. The distance between the lateral edges of said sealing tongues 34 and the lateral surfaces of the closed cooling air channels 28, 30, 32 is also very small and is preferably less than 2 mm.

In operation, cooling air is led through the cooling air channels 28, 30, 32, whereby the sheet metal casings of the cooling air channels are cooled, something that in turn entails cooling of the steel structures 10 of the furnace carts 8 and of the furnace cart wheels 12 including the bearings thereof. Since the cooling air channels 28, 30, 32 virtually completely fill the under-cart channel 22, and since further the sealing tongues 34 provide for tight sealing of the spaces between the cooling air channels, a longitudinal flow inside the under-cart channel 22 outside the area of the cooling air channels 28 to 32 virtually cannot occur. Since the cooling air is completely enclosed inside the closed cooling air channels 28 to 32, an exchange between cooling air and hot air from the burning channel 26 is not possible, so that special sealing arrangements are unnecessary.

A simple, additional sealing between the under-cart channel 22 and the burning channel 26 is provided by lateral continuous horizontal sealing strips 36 projecting from the steel structures 10 of the furnace carts 8 into the side walls 18.

What is claimed:

1. In a system for under-cart cooling of furnace carts in a tunnel furnace, said tunnel furnace including an elongated foundation, an elongated ceiling, and elongated side walls which define an elongated tunnel, and an elongated track for said furnace carts; said furnace carts including a frame structure for supporting material to be treated within said tunnel furnace and being configured to substantially divide said tunnel furnace into a burning channel above said furnace carts and an under-cart channel as defined by the undersides of said furnace carts, said tunnel foundation, and that part of said tunnel side walls which extend below the underside of the furnace carts, and having laterally spaced apart wheels for supporting said furnace carts on said track for movement in a longitudinal direction through said tunnel furnace, said wheels being disposed within said under-cart channel; said system including an elongated central duct mounted within said under-cart channel and extending in a longitudinal direction for a substantial distance therealong between said laterally spaced apart wheels of said furnace carts, said duct having one side disposed to extend closely adjacent to the underside of said furnace carts, and sides disposed to extend closely adjacent to one side of said wheels of said furnace carts, and to substantially fill said under-cart channel between the laterally spaced apart wheels of said furnace carts, and providing an elongated cooling air channel through which cooling air may be streamed for cooling of said under-cart channel.

2. A system as specified in claim 1 wherein an elongated side duct is disposed within said under-cart channel to each side of said laterally spaced apart wheels that is opposite from the side thereof adjacent said central duct and which extend longitudinally along said tunnel furnace between said wheels and the tunnel side wall respectively adjacent thereto.

3. A system as specified in claim 2 wherein said furnace carts include vertically disposed sealing tongues which extend from the under side thereof and into the space above said track as defined by the neighboring ducts to each side of said wheels.

4. A system as specified in claim 3 wherein said sealing tongues are provided at least at either end of each of said furnace carts.

5. A system as specified in claim 1 wherein said central duct is of sheet metal.

6. A system as specified in claim 2 wherein said central duct and each said side duct is of sheet metal.

7. A system as specified in claim 3 wherein the distance between the upper part of said central duct and the underside of said furnace carts, the distance between each said side duct and the underside of said furnace carts, and the distance from the lowermost reach of each said sealing tongues to said track is less than 5 mm.

8. A system as specified in claim 7 wherein each said distance is less than 2 mm.

* * * * *